US009774084B2

(12) United States Patent
Xu et al.

(10) Patent No.: US 9,774,084 B2
(45) Date of Patent: Sep. 26, 2017

(54) OMNIDIRECTIONAL BROADBAND ANTENNAS

(71) Applicant: Laird Technologies, Inc., Earth City, MO (US)

(72) Inventors: Yuan Xu, Nashua, NH (US); Athanasios Petropoulos, Hudson, NH (US); Shawn Wayne Johnson, Allenstown, NH (US)

(73) Assignee: Laird Technologies, Inc., Earth City, MO (US)

( * ) Notice: Subject to any disclaimer, the term of this patent is extended or adjusted under 35 U.S.C. 154(b) by 0 days.

(21) Appl. No.: 15/096,477

(22) Filed: Apr. 12, 2016

(65) Prior Publication Data

US 2016/0226145 A1 Aug. 4, 2016

Related U.S. Application Data

(63) Continuation of application No. PCT/US2014/010455, filed on Jan. 7, 2014.

(Continued)

(51) Int. Cl.

| | |
|---|---|
| ***H01Q 9/04*** | (2006.01) |
| ***H01Q 5/378*** | (2015.01) |
| ***H01Q 9/28*** | (2006.01) |
| ***H01Q 21/24*** | (2006.01) |
| *H01Q 5/307* | (2015.01) |
| *H01Q 19/26* | (2006.01) |
| *H01Q 19/32* | (2006.01) |

(52) U.S. Cl.

CPC ..... *H01Q 5/378* (2015.01); *H01Q 9/0464* (2013.01); *H01Q 9/28* (2013.01); *H01Q 21/24* (2013.01);

(Continued)

(58) Field of Classification Search

CPC .. H01Q 1/36; H01Q 1/48; H01Q 5/25; H01Q 5/307; H01Q 9/02; H01Q 9/40;

(Continued)

(56) References Cited

U.S. PATENT DOCUMENTS 4,225,869 A * 9/1980 Lohrmann ..... H01Q 21/08 343/773
4,608,572 A * 8/1986 Blakney ..... H01Q 1/48 343/792.5

(Continued)

FOREIGN PATENT DOCUMENTS

| | | |
|---|---|---|
| JP | 2005094367 A | 4/2005 |
| JP | 2007174121 A | 7/2007 |
| JP | 2012049864 A | 3/2012 |

OTHER PUBLICATIONS

Pending U.S. Appl. No. 14/804,655, filed Jul. 21, 2015, Chung et al.

(Continued)

*Primary Examiner* — Hoang Nguyen
*Assistant Examiner* — Awat Salih
(74) *Attorney, Agent, or Firm* — Harness, Dickey & Pierce, P.L.C.

(57) ABSTRACT

Disclosed are exemplary embodiments of omnidirectional broadband antennas. In an exemplary embodiment, an antenna generally includes a ground element, an antenna element, and an annular patch element. The antenna element may be electrically isolated from the ground element. The antenna element may include at least one portion that is substantially conical, substantially pyramidal, and/or that tapers in a longitudinal direction. The annular patch element is electrically grounded to the ground element. The annular patch element surrounds at least a portion of the antenna element and is parasitically coupled to the antenna element.

20 Claims, 16 Drawing Sheets

Related U.S. Application Data

(60) Provisional application No. 61/901,125, filed on Nov. 7, 2013.

(51) Int. Cl.
*H01Q 19/00* (2006.01)
*H01Q 9/02* (2006.01)
*H01Q 9/40* (2006.01)

(52) U.S. Cl.
CPC ..... *H01Q 5/307* (2015.01); *H01Q 9/02* (2013.01); *H01Q 9/40* (2013.01); *H01Q 19/005* (2013.01); *H01Q 19/26* (2013.01); *H01Q 19/32* (2013.01)

(58) Field of Classification Search
CPC ..... H01Q 9/0464; H01Q 19/32; H01Q 19/26; H01Q 19/005
USPC ..... 343/847, 893, 797
See application file for complete search history.

(56) References Cited

U.S. PATENT DOCUMENTS 4,658,262 A * 4/1987 DuHamel ..... H01Q 11/10 343/792.5
7,193,582 B2 * 3/2007 Wang ..... H01Q 9/42 343/702
2001/0050657 A1 * 12/2001 Meguro ..... B64G 1/222 343/915
2005/0122274 A1 * 6/2005 Marsan ..... H01Q 1/28 343/773
2006/0232490 A1 * 10/2006 Bisiules ..... H01Q 1/246 343/797
2008/0100521 A1 * 5/2008 Herbert ..... H01Q 1/1214 343/713
2010/0033401 A1 * 2/2010 Du ..... H01Q 1/007 343/893
2011/0243040 A1 * 10/2011 Khan ..... H04B 7/0617 370/280
2012/0282868 A1 * 11/2012 Hahn ..... H01Q 3/242 455/90.3
2013/0135161 A1 * 5/2013 Fujimoto ..... H01Q 1/3233 343/725
2015/0123868 A1 * 5/2015 Bit-Babik ..... H01Q 9/0464 343/857

OTHER PUBLICATIONS

International Search Report and Written Opinion for PCT Application No. PCT/US2014/010455 filed Jan. 7, 2014 (published as WO 2015/069309 on May 14, 2015) which is the parent application to the instant application, 12 pages.

* cited by examiner

Elevation Plane, Phi=90°

Elevation Plane, Phi=0°

Azimuth Plane, Theta=60°

OMNIDIRECTIONAL BROADBAND ANTENNAS

CROSS-REFERENCE TO RELATED APPLICATIONS

This application is a continuation of PCT International Application No. PCT/US2014/010455 filed Jan. 7, 2014 (published as WO 2015/069309 on May 14, 2015) which, in turn, claims the benefit of and priority to U.S. provisional application No. 61/901,125 filed Nov. 7, 2013. The entire disclosures of the above applications are incorporated herein by reference.

FIELD

The present disclosure relates to omnidirectional broadband antennas.

BACKGROUND

This section provides background information related to the present disclosure which is not necessarily prior art.

Omnidirectional antennas are useful for a variety of wireless communication devices because the radiation pattern allows for good transmission and reception from a mobile unit. Generally, an omnidirectional antenna is an antenna that radiates power generally uniformly in one plane with a directive pattern shape in a perpendicular plane, where the pattern is often described as "donut shaped." Sometimes, omnidirectional antennas may be installed indoors, such as mounted to a ceiling, and may be part of a distributed antenna system (DAS).

SUMMARY

This section provides a general summary of the disclosure, and is not a comprehensive disclosure of its full scope or all of its features Disclosed are exemplary embodiments of omnidirectional broadband antennas. In an exemplary embodiment, an antenna generally includes a ground element, an antenna element, and an annular patch element. The antenna element may be electrically isolated from the ground element. The antenna element may include at least one portion that is substantially conical, substantially pyramidal, and/or that tapers in a longitudinal direction. The annular patch element is electrically grounded to the ground element. The annular patch element surrounds at least a portion of the antenna element and is parasitically coupled to the antenna element.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Figure 1:
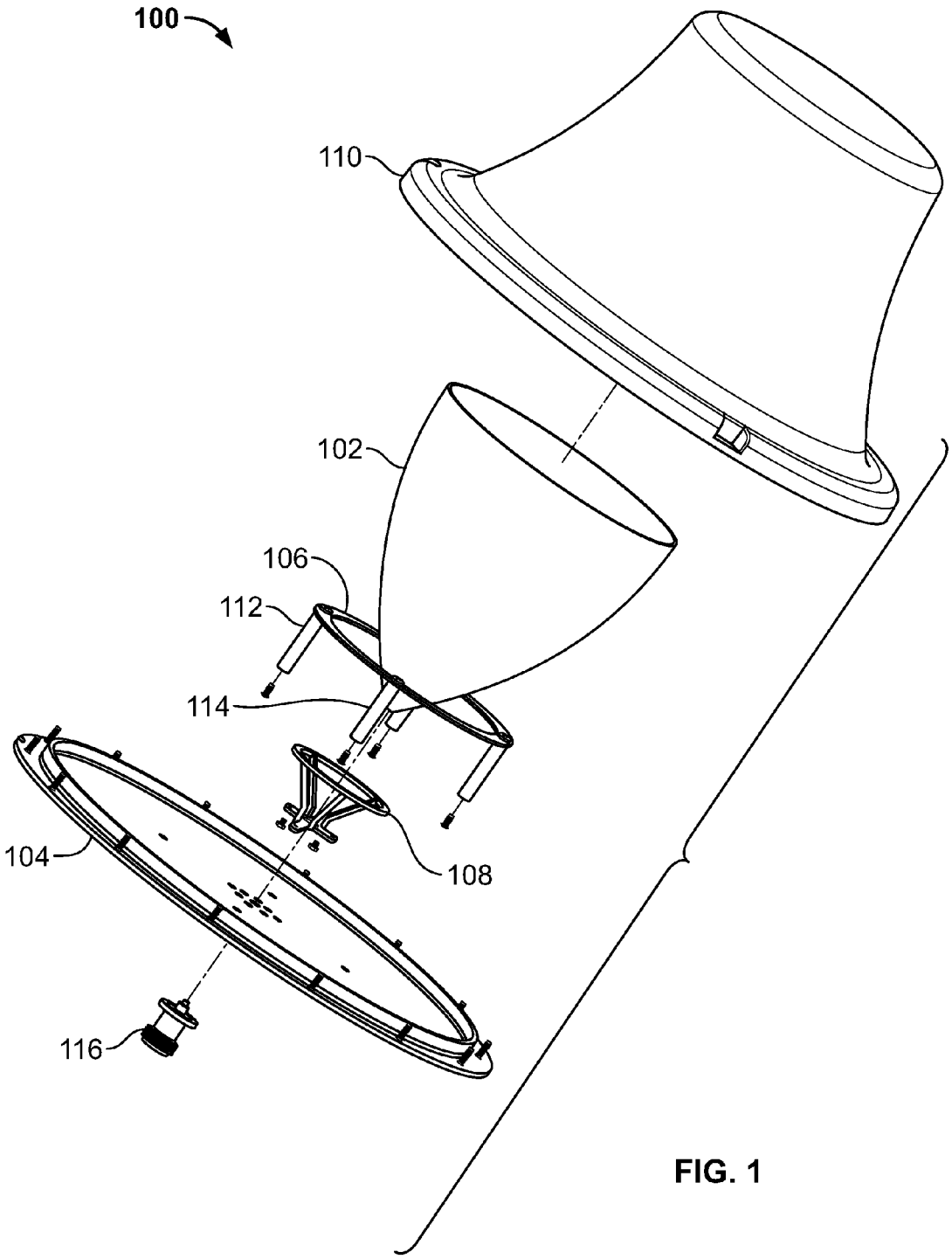
FIG. 1 is an exploded perspective view of an omnidirectional broadband antenna according to an exemplary embodiment.
Figure 2:
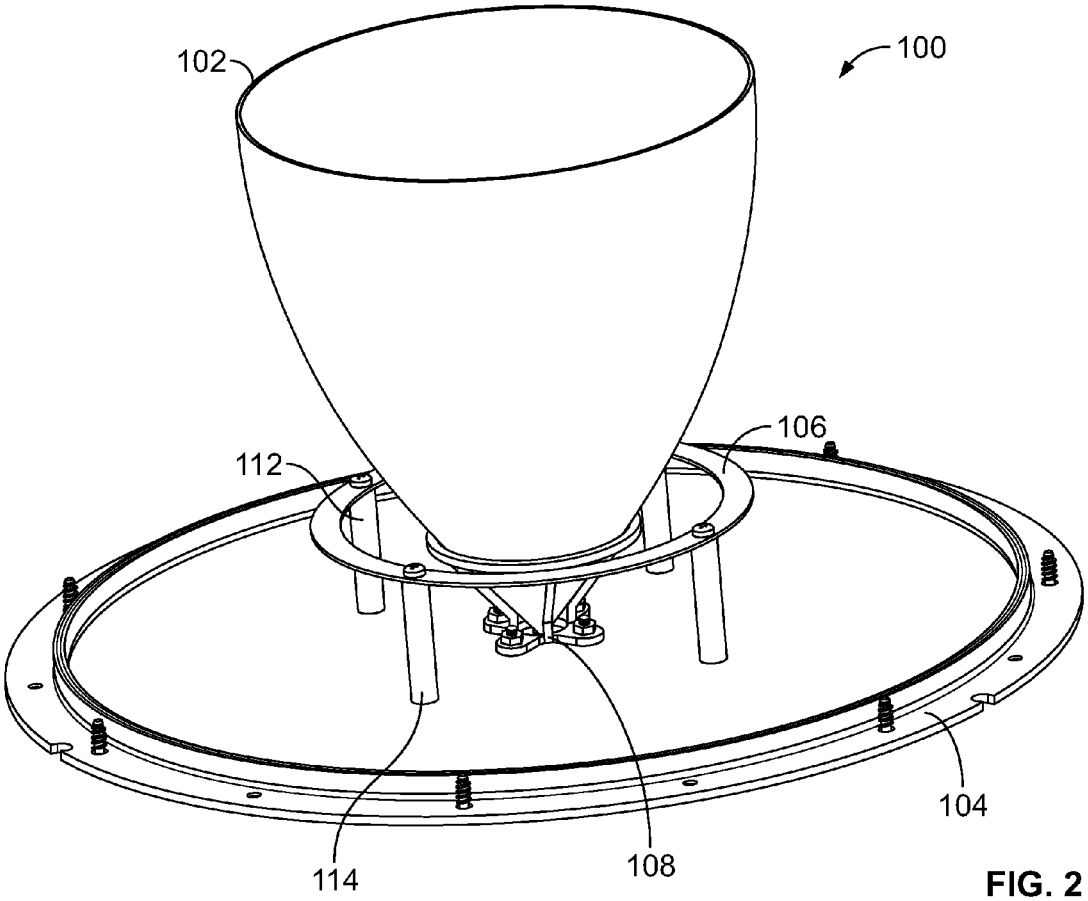
FIG. 2 is a perspective view of the exemplary antenna shown in FIG. 1 after the components have been assembled together, where the radome is not shown for clarity.
Figure 3:
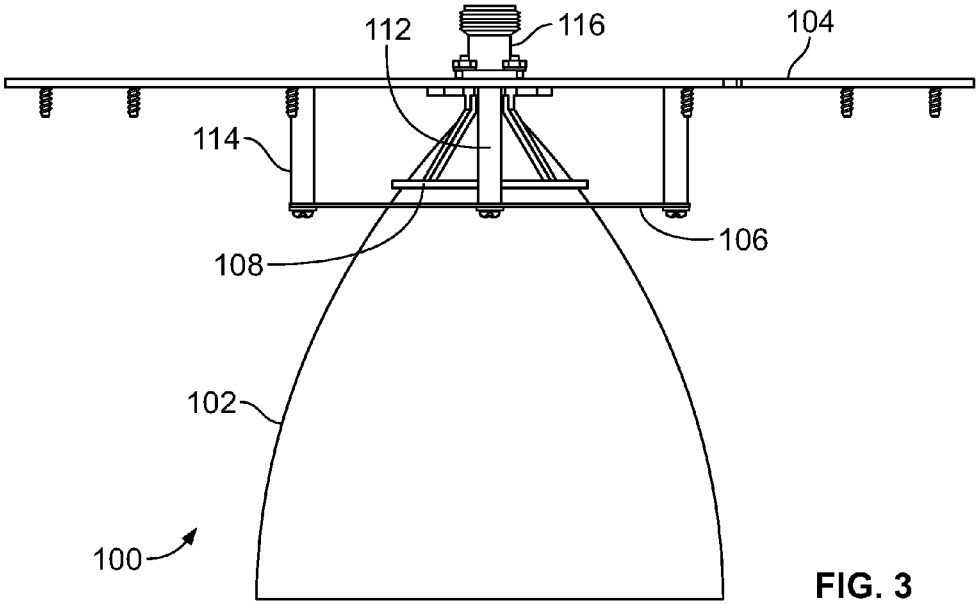
FIG. 3 is a side view of the exemplary antenna shown in FIG. 2.
Figure 9A:
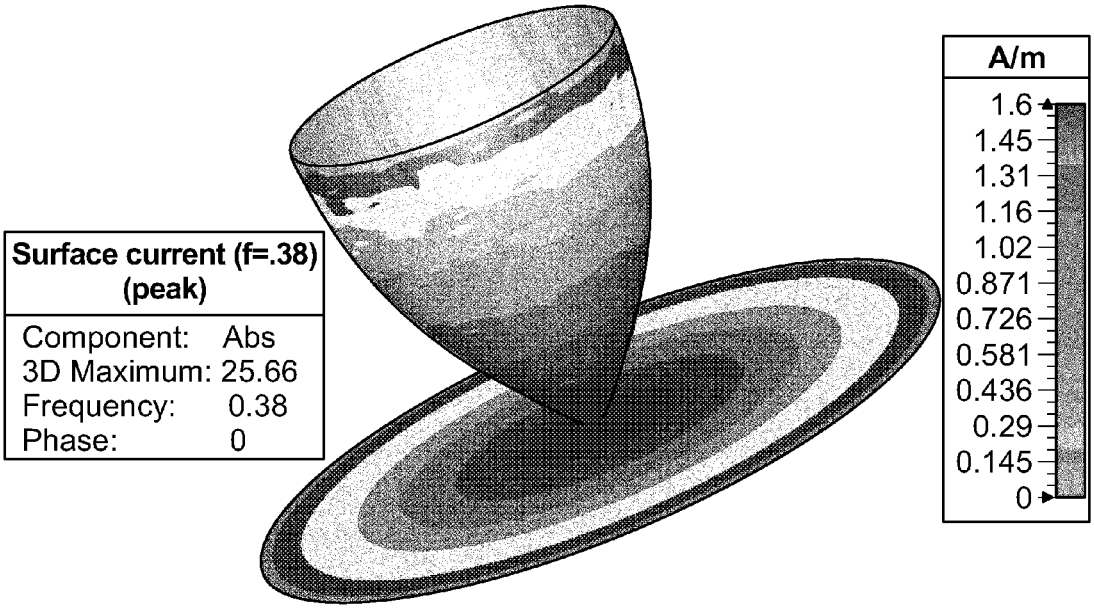
Figure 9B:
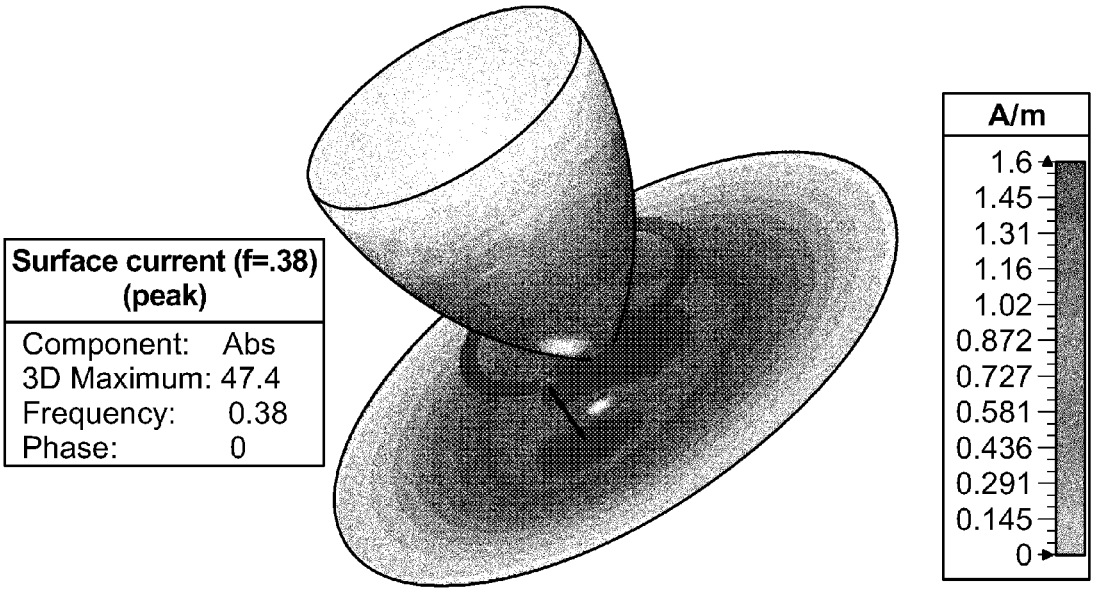
Figure 10A:
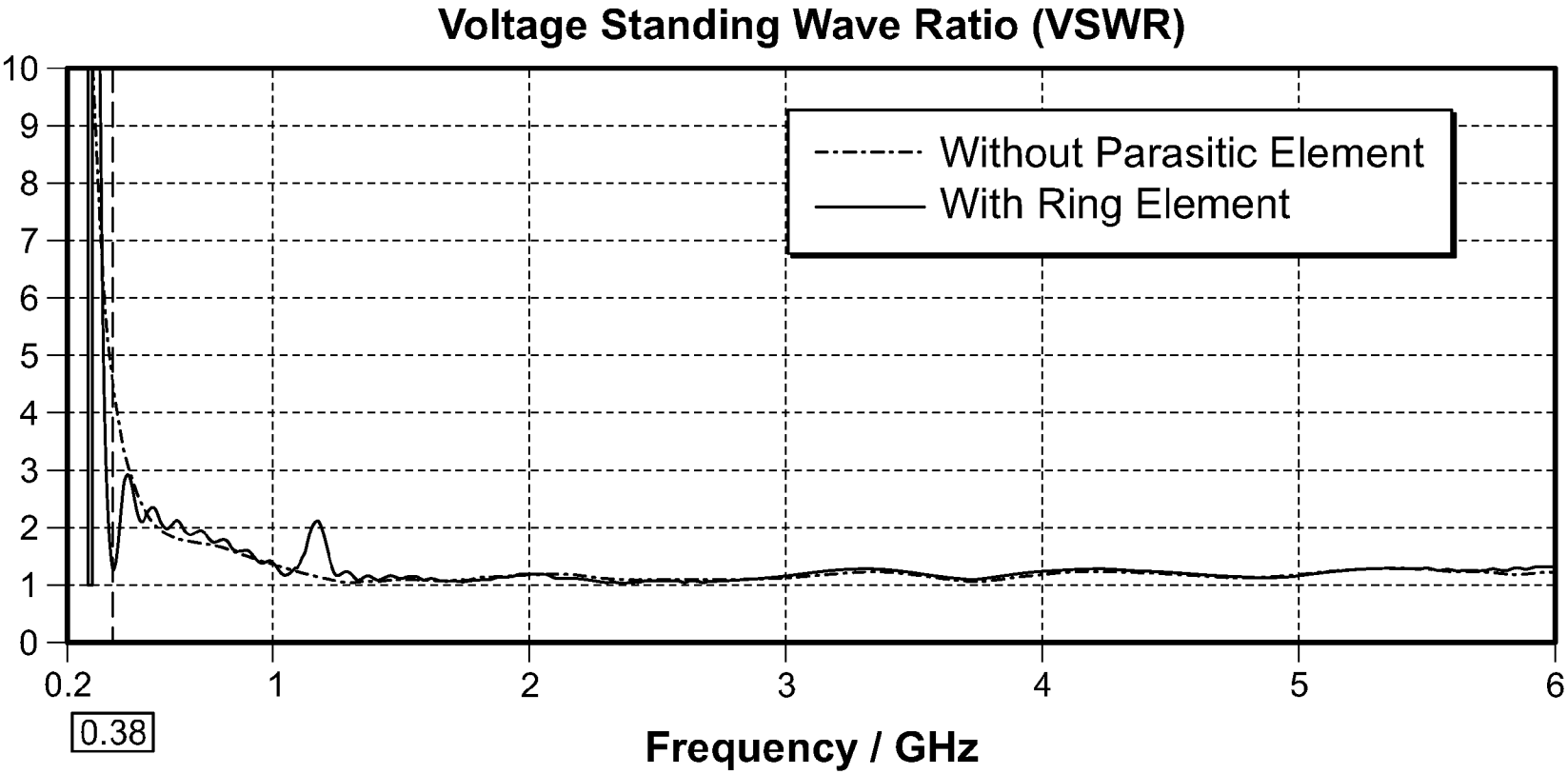
Figure 10B:
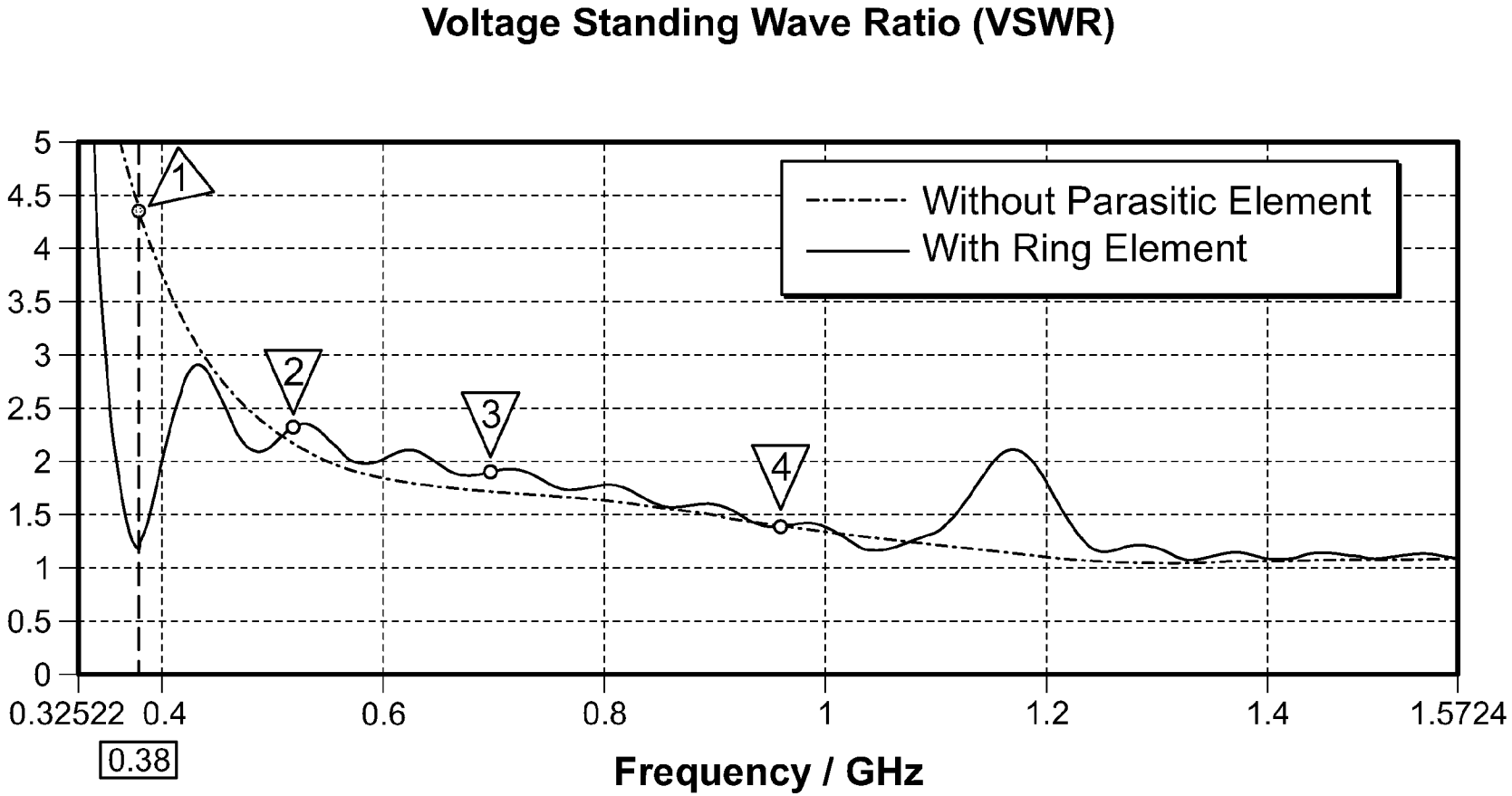
Figure 11A:
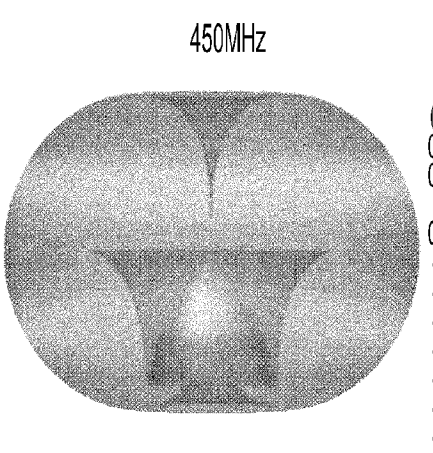
Figure 11B:
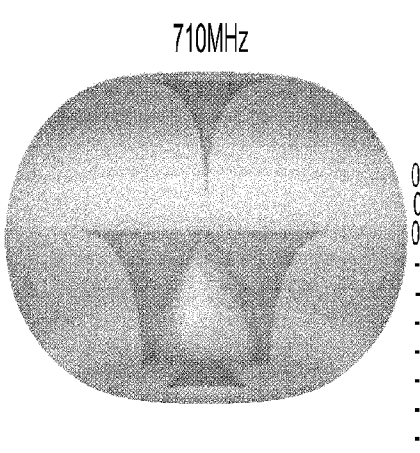
Figure 11C:
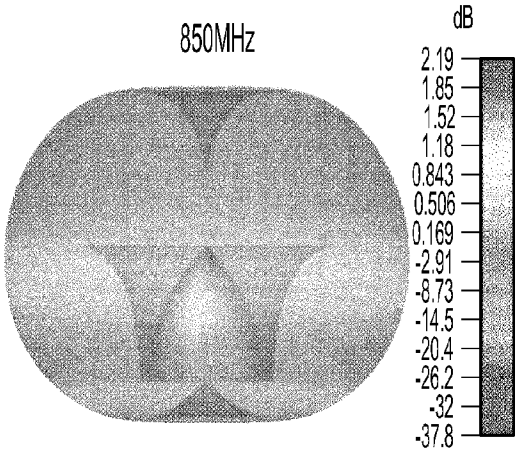
Figure 11D:
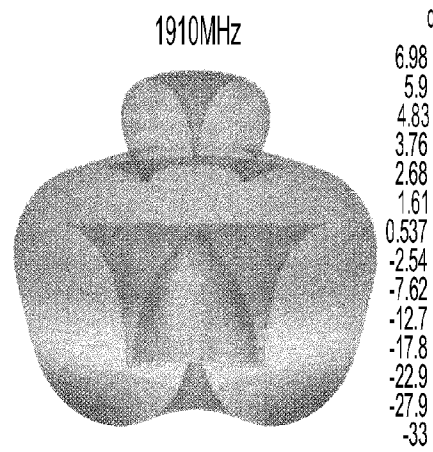
Figure 11E:
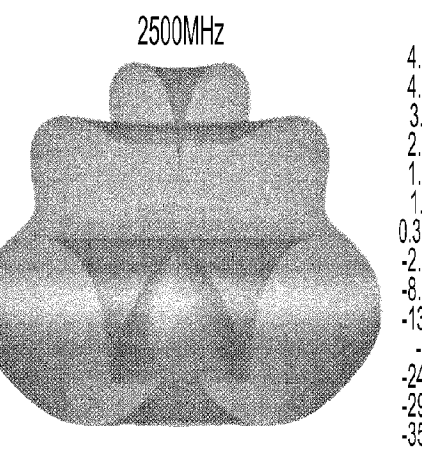
Figure 11F:
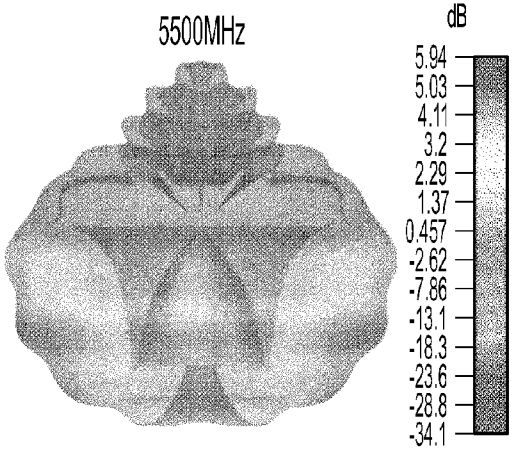
Figure 12A:
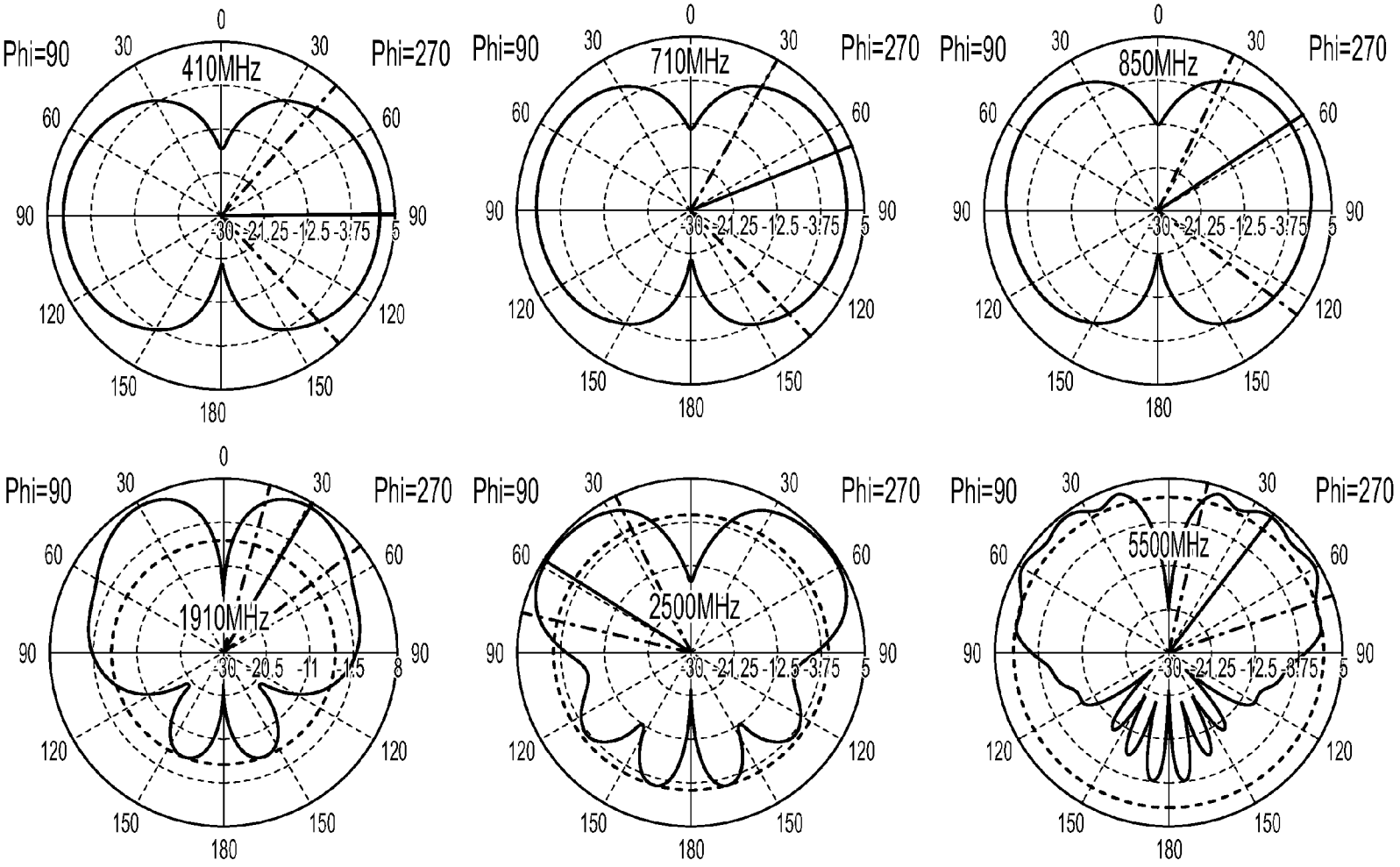
Figure 12B:
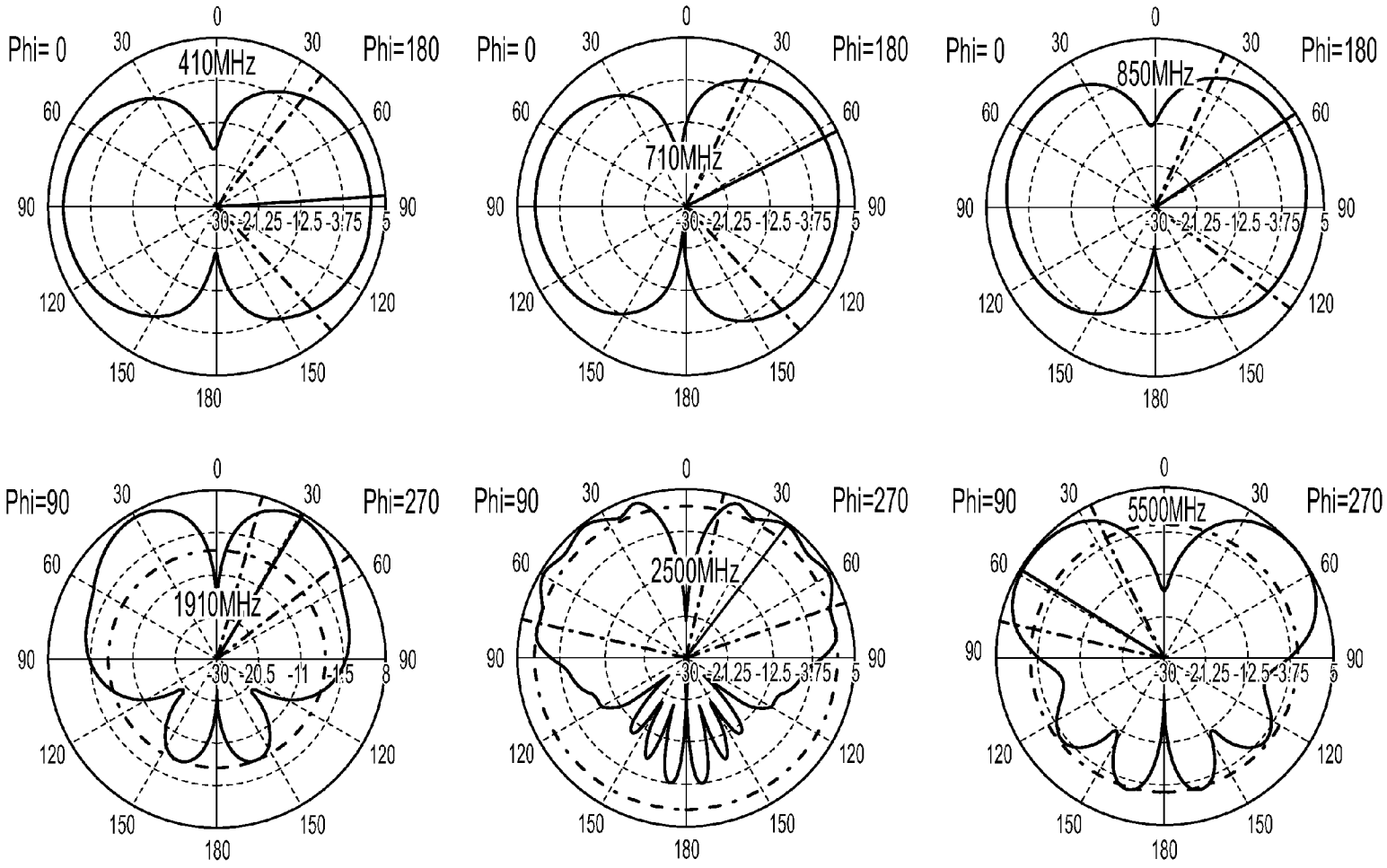
Figure 12C:
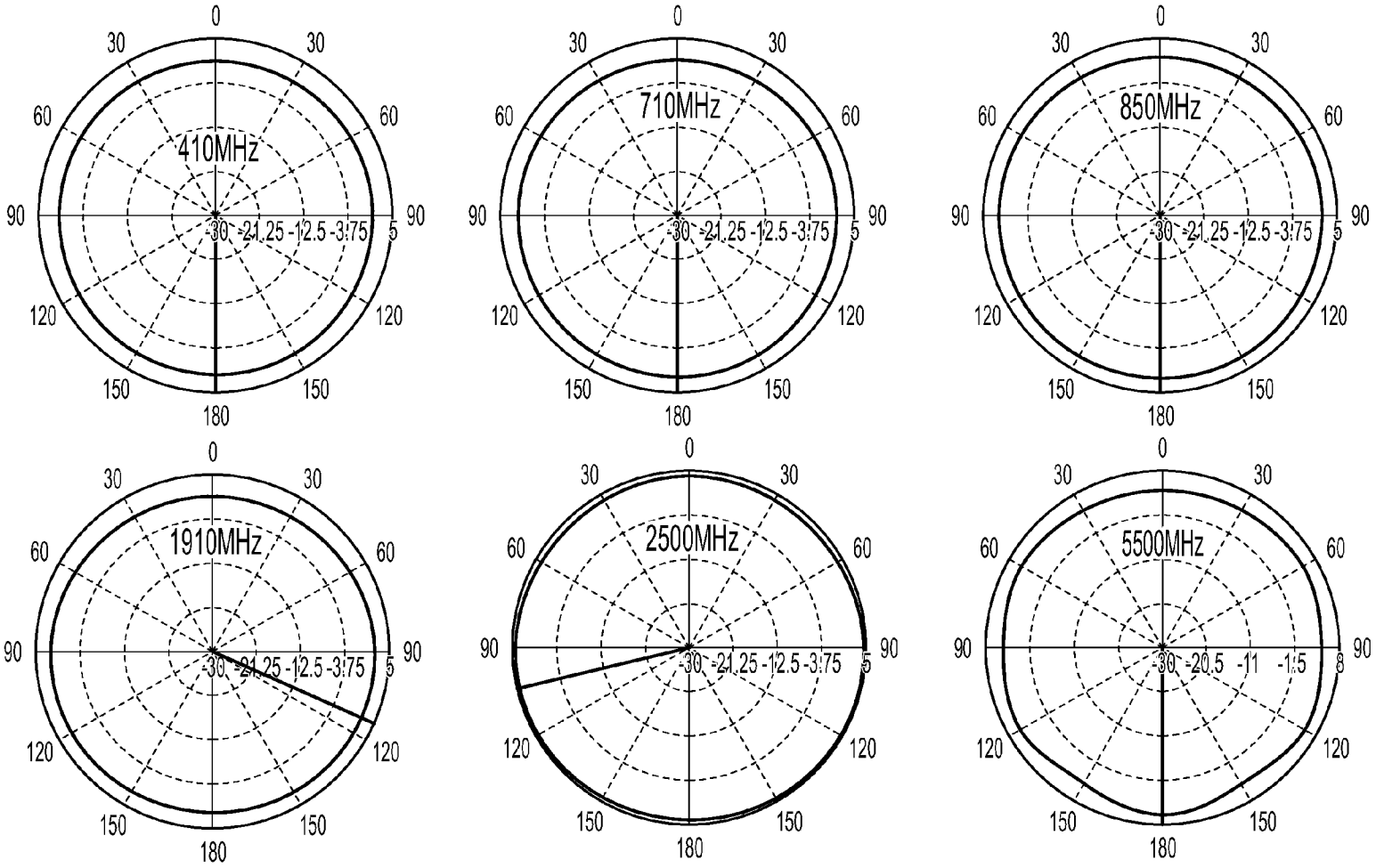
Figure 13:
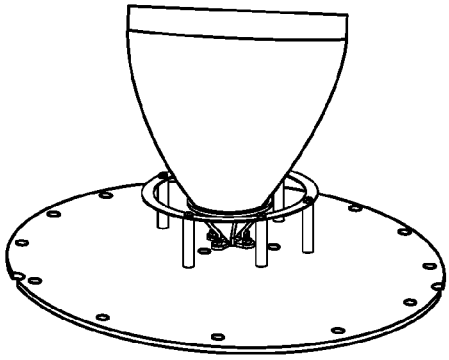
Figure 14:
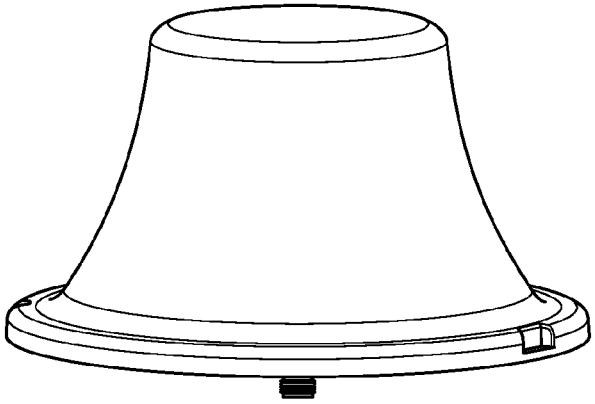
Figure 15:
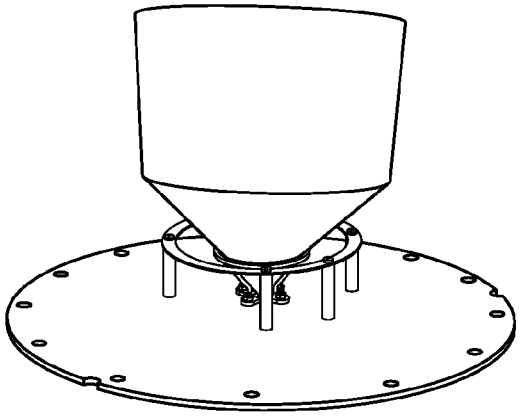
Figure 16:
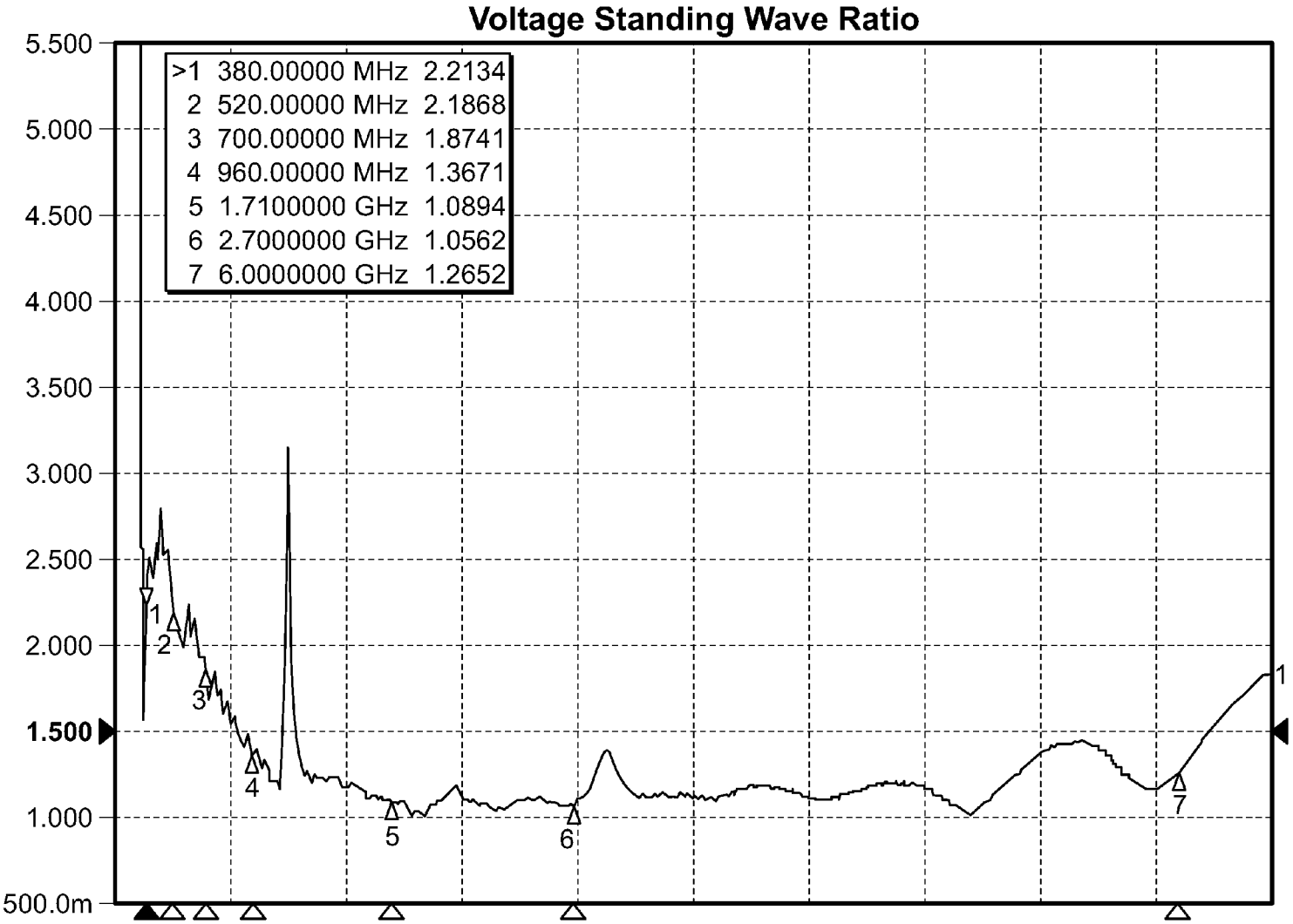
Figure 17:
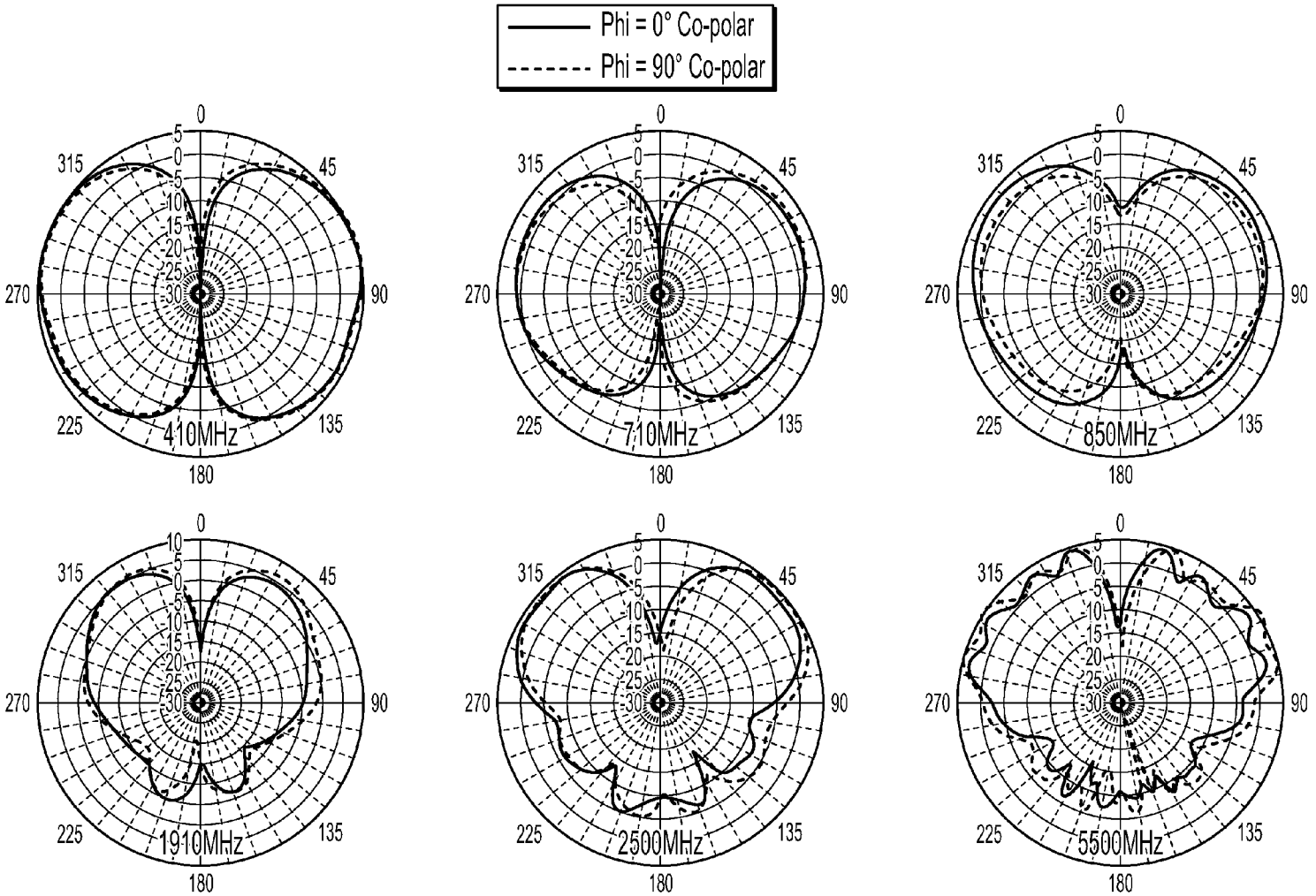
Figure 18:
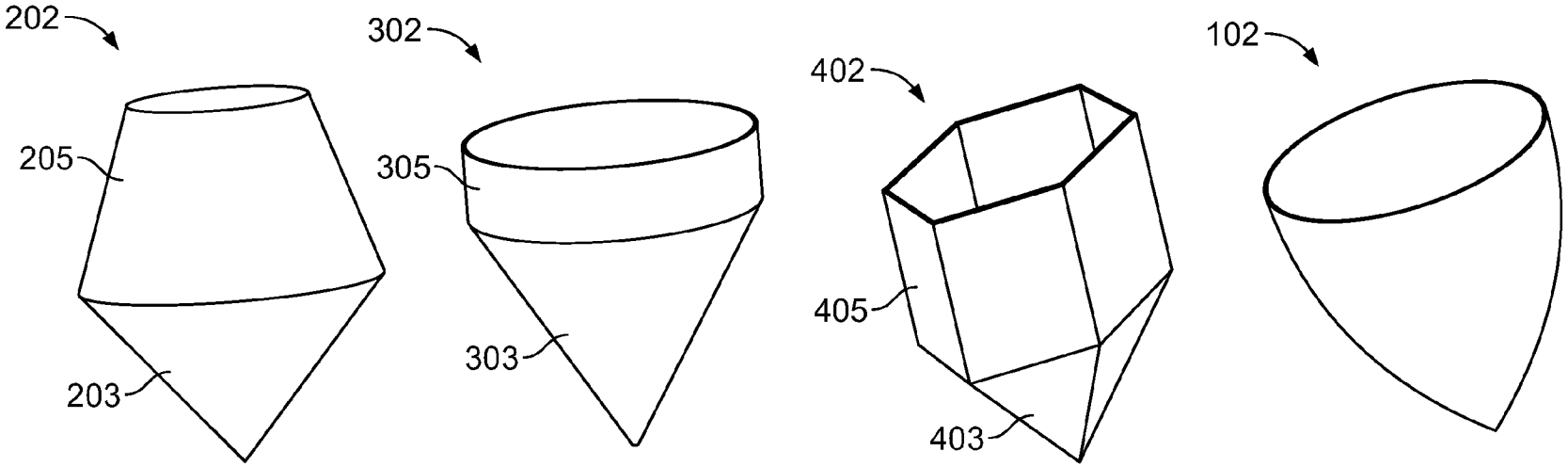

FIGS. 9A and 9B include computer simulation models showing surface currents at 380 MHz for the antenna element and ground plate shown in FIG. 1 without a parasitic ring element (FIG. 9A) and with a parasitic ring element (FIG. 9B);

FIGS. 10A and 10B are exemplary line graphs of voltage standing wave ratio (VSWR) versus frequency for computer simulation models of the exemplary antenna shown in FIG. 1 with the parasitic ring element and also without the parasitic ring element for comparison purposes;

FIGS. 11A through 11F illustrate radiation patterns for a computer simulation model of the exemplary antenna shown in FIG. 1 at frequencies of about 450 MHz, 710 MHz, 850 MHz, 1910 MHz, 2500 MHz, and 5500 MHz, respectively; and FIG. 12A illustrates radiation patterns for Elevation Plane Phi=90° for a computer simulation model of the exemplary antenna shown in FIG. 1 at frequencies of about 410 MHz, 710 MHZ, 850 MHz, 1910 MHz, 2500 MHz, and 5500 MHz;

FIG. 12B illustrates radiation patterns for Elevation Plane Phi=90° for a computer simulation model of the exemplary antenna shown in FIG. 1 at frequencies of about 410 MHz, 710 MHz, 850 MHZ, 1910 MHz, 5500 MHz, and 2500 MHz;

FIG. 12C illustrates radiation patterns Azimuth Plane Theta=60 for a computer simulation model of the exemplary antenna shown in FIG. 1 at frequencies of about 410 MHz, 710 MHz, 850 MHZ, 1910 MHz, 2500 MHz, and 5500 MHz;

FIG. 13 is a perspective view of a prototype of an omnidirectional broadband antenna according to the exemplary embodiment of FIGS. 1 through 3, where a radome is not shown for clarity;

FIG. 14 illustrates the prototype antenna of FIG. 13 shown with a radome according to an exemplary embodiment;

FIG. 15 is a perspective view of a prototype of an omnidirectional broadband antenna according to an alternative exemplary embodiment, where a radome is not shown for clarity;

FIG. 16 is an exemplary line graph of voltage standing wave ratio (VSWR) versus frequency measured for the prototype antenna shown in FIG. 13 with the radome shown in FIG. 14;

FIG. 17 illustrates radiation patterns for Elevation Plane measured for the prototype antenna shown in FIG. 13 with the radome shown in FIG. 14 at frequencies of about 410 MHz, 710 MHZ, 850 MHz, 1910 MHz, 2500 MHz, and 5500 MHz; and FIG. 18 includes perspective views of antenna elements having different shapes that may be used in omnidirectional broadband antennas according to exemplary embodiments.

Corresponding reference numerals indicate corresponding parts throughout the several views of the drawings.

DETAILED DESCRIPTION

Example embodiments will now be described more fully with reference to the accompanying drawings.

The inventors have observed that a typical extremely broadband antenna can be a self-complimentary/similar antenna structure, such as a bi-conical antenna. Because the actual antenna may be limited in size, the lower limit of the operating frequency is determined by the largest size of the antenna structure. The inventors have also observed that the size of the entire antenna is a critical parameter on the market, and that different configurations and processes have been presented to improve antenna bandwidth.

With reference now to the figures, FIG. 1 illustrates an example antenna 100 embodying one or more aspects of the present disclosure. As shown, the antenna 100 includes an antenna element 102 having an exponential tapered cone shape or form. The antenna 100 also includes a ground plate 104 (broadly, a ground element or member) and an electrically-conductive ring 106 (broadly, an annular or patch element). The ring 106 is electrically coupled to the ground plate 104 and parasitically coupled to the antenna element 102.

The electrically-conductive ring 106 surrounds at least a portion of the antenna element 102. The antenna 100 also includes an antenna element holder 108 connected to the ground plate 104. The antenna element holder 108 contacts at least a portion of the antenna element 102 to support and electrically isolate the antenna element 102 from the ground plate 104 while holding the antenna element 102 in place.

The antenna 100 may be a compact, ultra-broadband, in-building antenna, and may be used for applications such as a distributed antenna system. For example, the antenna 100 may be used indoors and may be mounted to a ceiling in some embodiments. The antenna 100 may be vertically polarized, and may operate at a frequency range between about 380 MHz and about 6000 MHz. The antenna 100 may support public safety frequency (TETRA).

The entire antenna element 102 is illustrated as having a conical, exponentially tapered form or shape. The illustrated antenna element 102 may comprise a cone have outwardly curved or convex sides in which the separation of the sides increases as an exponential function of length. The tapered cone form of the antenna element 102 may be shaped to improve bandwidth of the antenna 100. The tapered cone form may be optimized to create an optimized bandwidth in some embodiments. Although one example tapered cone form is illustrated in FIG. 1, other embodiments may include an antenna element having other forms or shapes (e.g., other exponential tapered shapes or conical forms, cones approaching the exponential taper, regular cone shaped, etc.). For example, FIG. 18 illustrates antenna elements 202, 302, and 402 having different shapes that may be used in omnidirectional broadband antennas according to exemplary embodiments.

The antenna element 102 may comprise any suitable material for radiating a signal at an operating frequency, such as, for example, an electrically-conductive metal, electrically-conductive alloy, electrically-conductive non-metal, electrically-conductive composite, brass, metalized plastic, printed electrically-conductive ink on a dielectric or non-conductive substrate, etc.

The ground plate 104 is illustrated as a flat, circular plate, located perpendicular to a center axis of the antenna element 102. Alternative embodiments may include other suitable ground members or ground planes besides the ground plate 104, such as a ground member having a non-circular shape (e.g., rectangular, octagonal, etc.) and/or that is not flat or plate like, etc.

In this exemplary embodiment, the center axis of the antenna element 102 is aligned with the center of the ground plate 104. The ground plate 104 is spaced apart from the antenna element 102 such that no electrically-conductive portion of the antenna element 102 is in contact with an electrically-conductive portion of the ground plate 104. The ground plate 104 may form a ground plane for the antenna 100. The ground plate 104 may comprise any suitable material for electrically grounding any connected components or received signals, such as, for example, an electrically-conductive metal, electrically-conductive alloy, electrically-conductive non-metal, electrically-conductive composite, aluminum, metalized plastic, printed electrically-conductive ink on a dielectric or non-conductive substrate, printed circuit board, etc.

The electrically-conductive ring 106 surrounds at least a portion of the antenna element 102 and parasitically or capacitively couples to the antenna element 102. The electrically-conductive ring 106 is electrically connected and grounded to the ground plate 104 via a grounding pin 112. Accordingly, the electrically-conductive ring 106 may also be referred to as a grounded parasitic patch ring element.

The electrically-conductive ring 106 is arranged horizontally over the ground plate 104. In some embodiments, the electrically-conductive ring 106 may act as a $\lambda/4$ wave trap for about a 400 MHz band operating frequency, which may make the bandwidth of the 400 MHz band wider. In some embodiments, the conductive ring diameter and location may be adjusted to improve the voltage standing wave ratio (VSWR) of the range of operating frequencies between about 380 MHz and about 520 MHz. The ring 106 may comprise any suitable material, such as, for example, an electrically-conductive metal, electrically-conductive alloy, electrically-conductive non-metal, electrically-conductive composite, brass, metalized plastic, printed electrically-conductive ink on a dielectric or non-conductive substrate, printed circuit board, etc.

In this exemplary embodiment, the electrically-conductive ring 106 is circular and positioned parallel to the ground plate 104. The center of the electrically-conductive ring 106 is aligned with the center axis of the antenna element 102, and is also aligned with the center of the ground plate 104. The electrically-conductive ring 106 may be concentric with the antenna element 102 and ground plate 104. The electrically-conductive ring 106 is positioned to surround at least a portion of the antenna element 102, but is spaced from the antenna element 102 such that no electrically-conductive portion of the antenna element 102 is in contact with the electrically-electrically-conductive ring 106.

Ring 106 radiates a vertically polarized wave omnidirectionally in the azimuth plane in the 380-520 MHz band. The directional gain is substantial in the azimuth plane, while the ripple of the radiation pattern is very low in the same plane. The utility of the ring 106 is that it radiates an omnidirectional wave at the very low band 380-520 MHz, while not disturbing the omnidirectional radiation pattern emanating from radiating element 102 at 700-6000 MHz frequencies.

The presence of the ring 106 makes the whole antenna 100 electrically small for the lower frequency band 380-520 MHz. Thus, the antenna 100 is compact and desirable for its size to customers. The symmetrical ring 106 around the antenna 102 makes the electrical fields be uniform and of about equal strength for all angles in the azimuth plane in the whole operating band 380-6000 MHz. Therefore, the radiating performance of the antenna 100 is superior to previous commercial antenna products.

The antenna element holder 108 is shaped to hold the antenna element 102 in place. The antenna element holder 108 acts as an isolator between the antenna element 102 and the ground plate 104. Accordingly, the antenna element holder 108 helps to prevent the antenna element 102 from making direct galvanic contact with the ground plate 104.

The antenna element holder 108 may be mechanically fastened to the ground plate 104 using any suitable means, such as, for example, a plurality of screws. The antenna element holder 108 may be positioned to contact the antenna element 102 to keep the antenna element 102 in a substantially perpendicular position relative to the ground plate 104. In some embodiments, the antenna element holder 108 may contact the antenna element 102 with a surrounding support ring.

The antenna element holder 108 is illustrated as merely contacting the antenna element 102 and not mechanically fastened to the antenna element 102 with any fasteners or connectors. But other embodiments may include an antenna holder that is directly connected (e.g., mechanically fastened, etc.) to the antenna element 102. In some embodiments, the antenna element holder 108 may only provide support for the antenna element 102, and other structures and/or connections may be necessary to prevent any movement of the antenna element 102 in any direction. The antenna element holder 108 may comprise any material suitable for electrically isolating the antenna element 102 and ground plate 104 and providing support to the antenna element 102, such as, for example, plastic, a composite material, a dielectric material, etc.

In some embodiments, the antenna 100 may include a radome, cover, or housing 110. The radome 110 may be configured to cover other components of the antenna 100, to protect them from external elements, or hide them from user view. The radome 110 may be connected to the ground plate 104 using any suitable connectors, such as, for example, a plurality of screws. The radome 110 may comprise any material (e.g., plastic, etc.) suitable for allowing radiated signals to pass through the radome 110. In some embodiments, the radome 110 may be shaped to cover the other antenna components with a minimal profile. In the embodiment illustrated in FIG. 1, the radome 110 includes a closed, circular end cap portion having a diameter slightly larger than the diameter of the antenna element 102, and an open, circular base portion having a diameter substantially similar to the diameter of the ground plate 104.

The antenna 100 may also include a grounding pin 112 connected between the electrically-conductive ring 106 and the ground plate 104. The pin 112 may be metallized to act as an electrically-conductive connection from the electrically-conductive ring 106 to the ground plate 104. The pin 112 may be configured to also provide support for the electrically-conductive ring 106 to position the ring 106 parallel to the ground plate 104. The grounding pin 112 may comprise any suitable material, such as, for example, an electrically-conductive metal, electrically-conductive alloy, electrically-conductive non-metal, electrically-conductive composite, brass, metalized plastic, printed electrically-conductive ink on a dielectric or non-conductive substrate, etc.

The antenna 100 may also include a plurality of support pins 114 connected between the electrically-conductive ring 106 and the ground plate 104. The support pins 114 may be configured to support the electrically-conductive ring 106 such that the electrically-conductive ring 106 is spaced apart from and generally parallel to the ground plate 104. The support pins 114 may comprise any material suitable for supporting the electrically-conductive ring 106, such as, for example, plastic, other dielectric materials, etc. Although FIG. 1 illustrates one grounding pin 112 and three support pins 114, other embodiments may include more than one grounding pin, and more or less than three support pins. The electrically-conductive grounding pin 112 and support pins 114 may be perpendicular to the ground plate 104.

The antenna 100 may also include a coaxial plug element 116 (broadly, a connector) having an inner conductor and an outer conductor. A recess, opening, or hole may be located at about the center of the ground plate 104. The plug element 116 may be positioned and attached (e.g., mechanically fastened, etc.) underneath the opening. The outer conductor of the plug 116 may be electrically conductively connected to the ground plate 104. The inner conductor of the plug 116 may pass through the opening and be electrically conductively connected to the antenna element 102. For example, the inner conductor of the plug 116 may be soldered to the apex or end of the cone shape of the antenna element 102. The coaxial plug element 116 may be configured to connect the antenna 100 to other systems so that the antenna 100 is capable of sending and/or receiving signals using the antenna element 102 and the coaxial plug element 116.

FIG. 2 is a perspective view of the exemplary antenna 100 shown in FIG. 1. The antenna 100 is illustrated showing an antenna element 102, a ground plate 104, an electrically-conductive ring 106, an antenna element holder 108, an electrically-conductive grounding pin 112, and support pins 114.

FIG. 3 is a side view of the exemplary antenna 100 shown in FIG. 1. The antenna 100 is illustrated showing an antenna element 102, a ground plate 104, an electrically-conductive ring 106, an antenna element holder 108, an electrically-conductive grounding pin 112, support pins 114, and a coaxial plug element 116.

Figure 4:
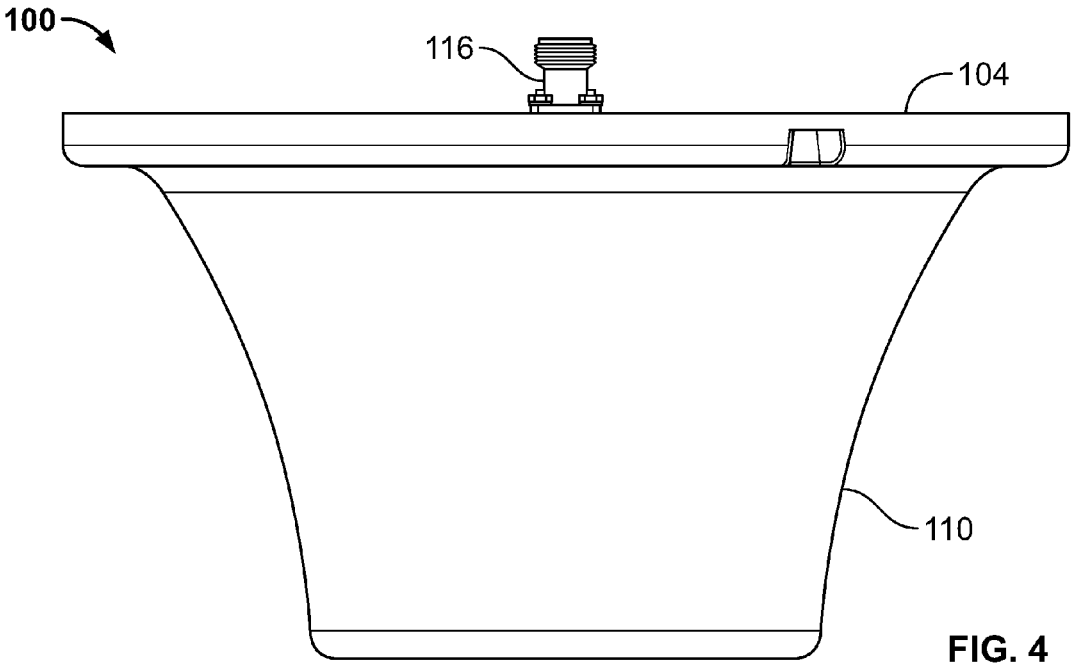
FIG. 4 is a side view of the exemplary antenna of FIG. 2 shown with the radome.

FIG. 4 is another side view of the exemplary antenna 100 shown in FIG. 1. The antenna 100 is illustrated with a radome 110 having an end cap portion and a base portion. The radome 110 covers other antenna components inside the radome 110, such as an antenna element. The end cap portion has a diameter slightly larger than the diameter of the antenna element 102, and the base portion has a diameter substantially similar to the diameter of the ground plate 104. The antenna 100 also includes a coaxial plug element 116. The antenna 100 may have a vertical orientation as illustrated in FIG. 2 when the antenna is mounted to an indoor ceiling.

Figure 5:
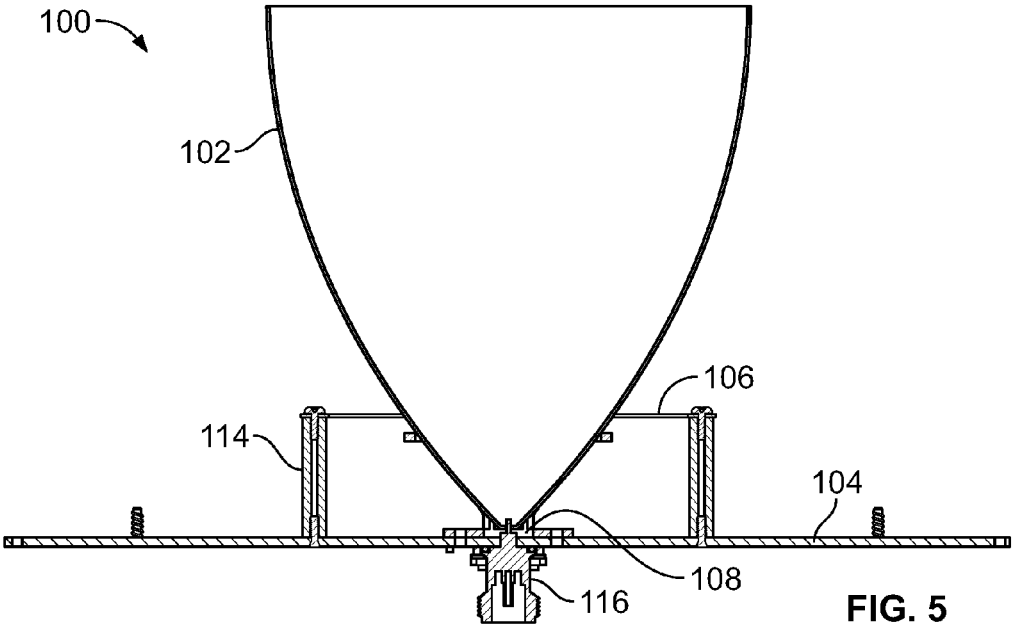
FIG. 5 is a vertical cross-sectional view of the exemplary antenna shown in FIG. 3.

FIG. 5 is a side view cross-sectional view of the exemplary antenna 100 shown in FIG. 1. The antenna 100 is illustrated showing an antenna element 102, a ground plate 104, an electrically-conductive ring 106, an antenna element holder 108, support pins 114, and a coaxial plug element 116. The cross section has been taken perpendicular to the ground plate 104 and the antenna element 102, and passes through the center axis of the antenna element 102 and the center of the ground plate 104.

Figure 6:
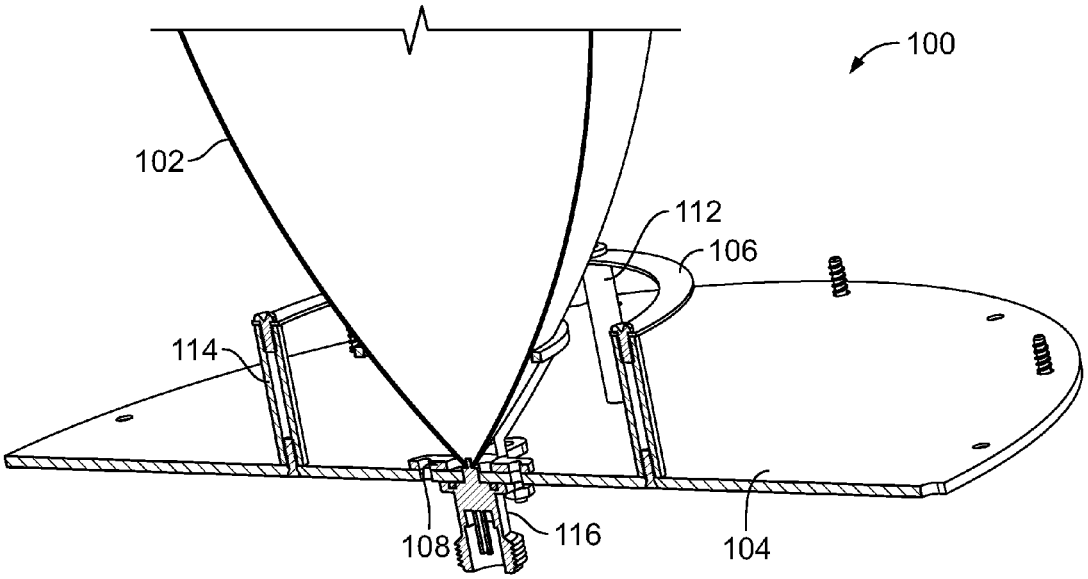
FIG. 6 is a perspective cross-sectional of the exemplary antenna shown in FIG. 2.

FIG. 6 is a perspective cross-sectional view of the exemplary antenna 100 shown in FIG. 1. The antenna 100 is illustrated showing an antenna element 102, a ground plate 104, an electrically-conductive ring 106, an antenna element holder 108, electrically-conductive pin 112, support pins 114, and a coaxial plug element 116. The cross section has been taken perpendicular to the ground plate 104 and the antenna element 102, and passes through the center axis of the antenna element 102 and the center of the ground plate 104.

Figure 7:
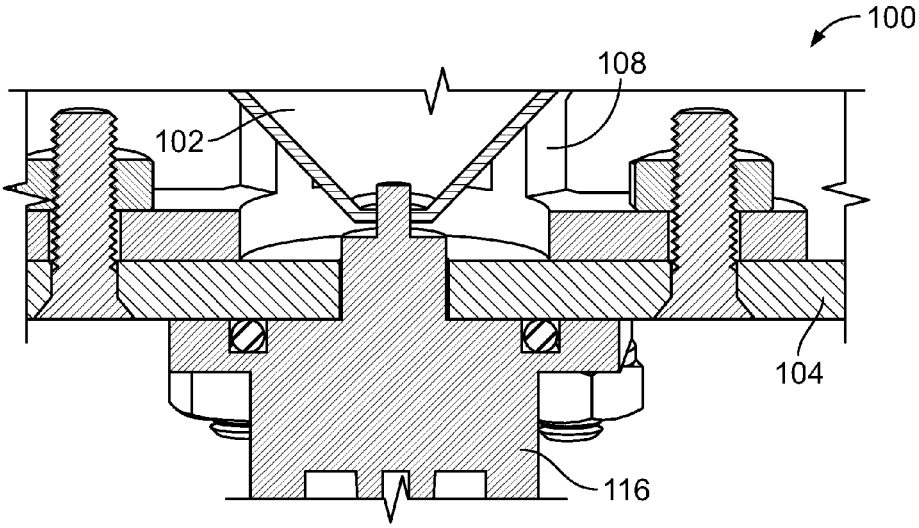
FIG. 7 is a vertical cross-sectional view of the cable mount interface of the exemplary antenna shown in FIG. 1.

FIG. 7 is a vertical cross-sectional view of a cable mount interface of the exemplary antenna 100 shown in FIG. 1. The antenna 100 is illustrated showing an antenna element 102, a ground plate 104, an antenna element holder 108, and a coaxial plug element 116. The ground plate 104 includes an opening, hole or recess. The plug element 116 is positioned and attached in and underneath the opening. The outer conductor of the plug element 116 is electrically conductively connected to the ground plate 104. The inner conductor of the plug element 116 is passed through the opening and connected to the antenna element 102.

Figure 8:
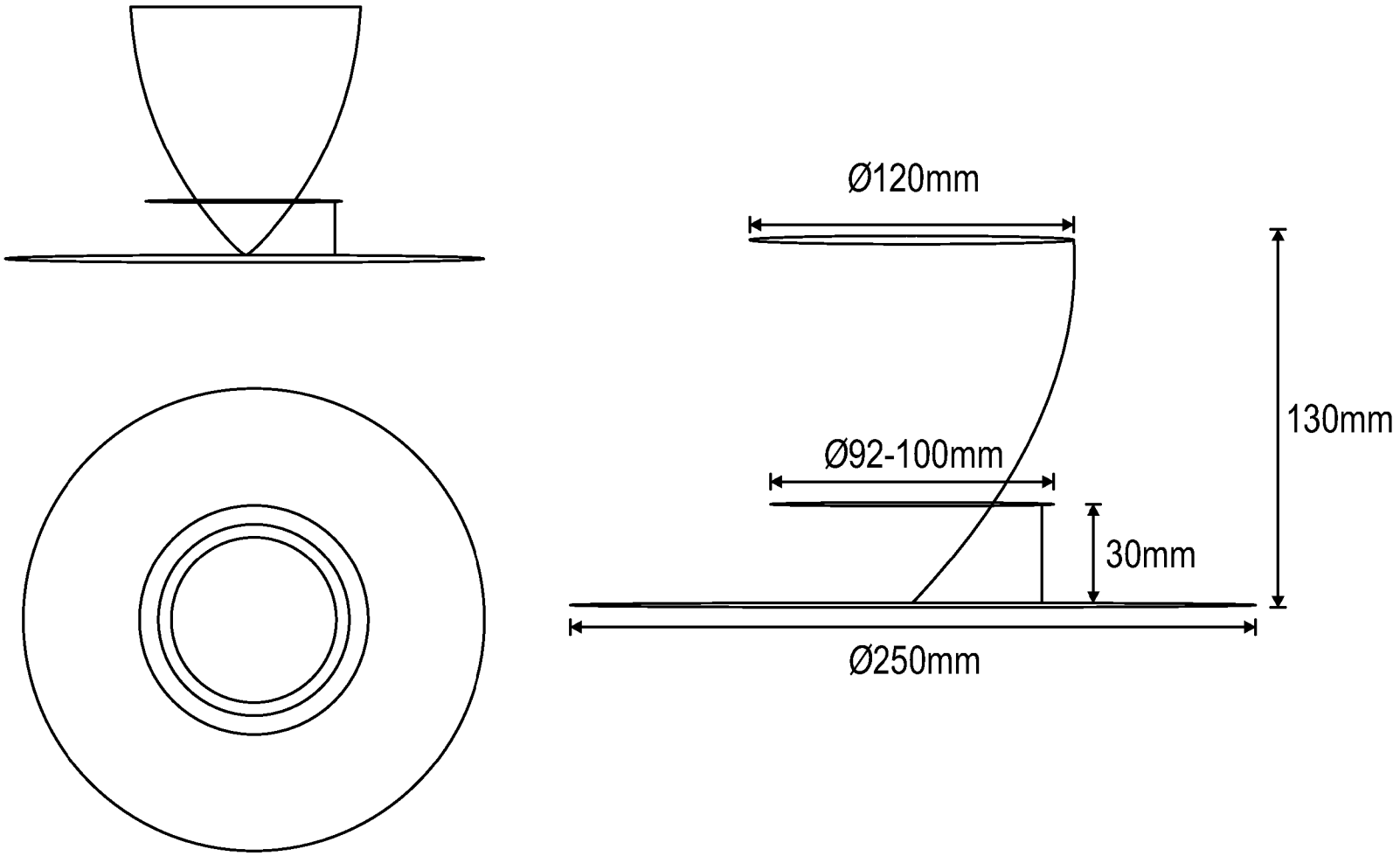
FIG. 8 illustrates the antenna element of the antenna shown in FIG. 1, where the exemplary dimensions are provided for purposes of illustration only according to exemplary embodiments.

FIG. 8 is a view of the exemplary antenna 100 shown in FIG. 1 with exemplary dimensions. The antenna element opening has a diameter of about 120 mm, and the antenna element 102 has a height of about 130 mm. The electrically-conductive ring 106 has a diameter in a range between about 92 mm and about 100 mm, and a width of about 6 mm. In this embodiment, the electrically-conductive ring 106 is separated from the ground plate 104 by about 30 mm. In other embodiments, the electrically-conductive ring 106 may be separated from the ground plate 104 by other distances, such as, for example, about 50 mm. The ground plate 104 has a diameter of about 250 mm. Although the radome 110 is not illustrated in FIG. 8 the radome may have a base portion diameter of about 250 mm, an end cap diameter of about 132 mm, and a height of about 140 mm. Although FIG. 8 illustrates dimensions for several of the antenna components according to one example embodiment, it is understood that other dimensions may be used in other embodiments without departing from the scope of the present disclosure FIGS. 9A and 9B include computer simulation models generated in CST Microwave Studio® 3D EM simulation software. More specifically, FIGS. 9A and 9B show surface currents for the antenna element 102 and ground plate 104 shown in FIG. 1 without any electrically-conductive ring (FIG. 9A) and with the electrically-conductive ring 106 (FIG. 9B). The electrically-conductive ring 106 may be a parasitic patch element, acting as a $\lambda/4$ wave trap for a 400 MHz band operating frequency. A resonant mode can be excited and operated close to 400 MHz, which can make the bandwidth of the 400 MHz band wider. The patch ring diameter and location can be adjusted to achieve a VSWR of less than 3.0 to one for the 380 MHz to 520 MHz band. In this example, the electrically-conductive ring 106 had a radius of 50 mm and a width of 6 mm, and was located a height of 30 mm over the ground plate or plane 104. Alternative embodiments may include a differently configured grounded patch parasitic element than the electrically-conductive ring 106, e.g., larger, smaller, non-circular, different location, etc.

FIGS. 10A and 10B are exemplary line graphs of voltage standing wave ratio (VSWR) versus frequency for computer simulation models of the exemplary antenna 100 with the parasitic ring element 106 and also without the parasitic ring element for comparison purposes. More specifically, FIG. 10A is an exemplary line graph of the VSWR versus frequency from 200 MHz to 6 GHz for the antenna 100 with and without the electrically-conductive ring 106. FIG. 10B is an exemplary line graph of the VSWR versus frequency from about 325 MHz to about 1.57 GHz for the antenna 100 with and without the electrically-conductive ring 106. The VSWR line graphs generally demonstrate that the performance of the antenna 100 with the electrically-conductive ring 106 is superior to the performance of the antenna without the electrically-conductive ring, especially at a frequency of about 380 MHz. Extra resonance is created around about 380 MHz, and the VSWR is improved from about 4.35 to less than 2.5. For example, FIGS. 10A and 10B shows that the antenna 100 with and without the electrically-conductive ring 106 had a VSWR of about 1.213 and 4.358, respectively, at a frequency of 380 MHz. FIG. 10B shows that the antenna 100 with the electrically-conductive ring 106 had a VSWR of about 2.315 at a frequency of 520 MHz, a VSWR of about 1.897 at a frequency of 698 MHz, and a VSWR of about 1.374 at a frequency of 960 MHz.

FIGS. 11A through 11F illustrate radiation patterns for a computer simulation model of the exemplary antenna 100. More specifically, FIG. 11A illustrates a radiation pattern of the antenna 100 at an operating frequency of 450 MHz. FIG. 11B illustrates a radiation pattern of the antenna 100 at an operating frequency of 710 MHz. FIG. 11C illustrates a radiation pattern of the antenna 100 at an operating frequency of 850 MHz. FIG. 11D illustrates a radiation pattern of the antenna 100 at an operating frequency of 1910 MHz. FIG. 11E illustrates a radiation pattern of the antenna 100 at an operating frequency of 2500 MHz. FIG. 11F illustrates a radiation pattern of the antenna 100 at an operating frequency of 5500 MHz. Generally, FIGS. 11A through 11F show that the antenna 100 has good omnidirectional radiation patterns for frequencies from about 380 MHz to about 6 GHz.

FIGS. 12A through 12C illustrate two-dimensional radiation patterns for a computer simulation model of the exemplary antenna 100 at typical frequencies of operation. More specifically, FIG. 12A shows far-field gain abs for Elevation Plane Phi=90° at frequencies of about 410 MHz, 710 MHz, 850 MHz, 1910 MHz, 2500 MHz, and 5500 MHz. FIG. 12B shows far-field gain (1D results) for Elevation Plane Phi=0° at frequencies of about 410 MHz, 710 MHz, 850 MHZ, 1910 MHz, 2500 MHz, and 5500 MHz. FIG. 12C shows far-field gain abs for Azimuth Plane Theta=60° at frequencies of about 410 MHz, 710 MHz, 850 MHZ, 1910 MHz, 2500 MHz, and 5500 MHz.

In this exemplary embodiment, the exemplary antenna 100 had a VSWR of less than or equal to about three to one (3:1) when operating in a frequency range between about 380 MHz and 520 MHz, a VSWR of less than or equal to about two to one (2:1) when operating in a frequency range between about 698 MHz and 960 MHz, and a VSWR of less than or equal to about 1.8 to one (1.8:1) when operating in a frequency range between about 1710 MHz and about 6000 MHz. Although the exemplary antenna 100 of FIG. 1 has the above VSWR values at specified operating frequencies, it is understood that other embodiments may have different VSWR values for various ranges of operating frequencies.

The exemplary antenna 100 has a gain of about 2 decibels isotropic (dBi) when operating in a frequency range between about 380 MHz and 520 MHz, a gain of about 3 dBi when operating in a frequency range between about 698 MHz and 960 MHz, a gain of about 7 dBi when operating in a frequency range between about 1710 MHz and about 4300 MHz, and a gain of about 6 dBi when operating in a frequency range between about 4300 MHz and about 6000

MHz. Although the exemplary antenna 100 of FIG. 1 has the above gain values at specified operating frequencies, it is understood that other embodiments may have different gain values for other ranges of operating frequencies.

FIG. 13 is a perspective view of a prototype of an omnidirectional broadband antenna 100 according to the exemplary embodiment of FIGS. 1 through 3, where the radome 110 is not shown for clarity. FIG. 14 illustrates the prototype antenna of FIG. 13 shown with a radome 110 according to an exemplary embodiment. In this example, the prototype antenna had a compact form with a ground plate diameter of 250 mm, a height of 134 mm, and an end cap diameter of 120 mm.

FIG. 15 is a perspective view of a prototype of an omnidirectional broadband antenna according to an alternative exemplary embodiment, where the radome is not shown for clarity. In this example, the antenna element includes a first portion that is conical and a second portion that is cylindrical.

FIG. 16 is an exemplary line graph of voltage standing wave ratio (VSWR) versus frequency from 200 MHz to 6500 MHz measured for the prototype antenna shown in FIG. 13 with the radome shown in FIG. 14. The VSWR line graph generally demonstrates the excellent performance of the prototype antenna with the electrically-conductive ring. FIG. 16 also shows that the prototype antenna 100 with the electrically-conductive ring had a VSWR of about 2.213 at a frequency of 380 MHz, a VSWR of 2.187 at a frequency of 520 MHz, a VSWR of about 1.874 at a frequency of 700 MHz, a VSWR of about 1.367 at a frequency of 960 MHz, a VSWR of about 1.089 at a frequency of 1.71 GHz, a VSWR of about 1.056 at a frequency of 2.70 GHz, and a VSWR of about 1.265 at a frequency of 6 GHz.

FIG. 17 illustrates radiation patterns for Elevation Plane measured for the prototype antenna shown in FIG. 13 with the radome shown in FIG. 14 at frequencies of about 410 MHz, 710 MHZ, 850 MHz, 1910 MHz, 2500 MHz, and 5500 MHz.

FIG. 18 illustrates antenna elements 202, 302, and 402 having different shapes that may be used in omnidirectional broadband antennas according to exemplary embodiments. As shown, the entire antenna element 102 has a cone shape that conically widens in a longitudinal direction. The antenna element 102 also has sides that taper in the opposite longitudinal direction to a point. The antenna element 102 has a circular base and sides that conically taper from the circular base to a point in this example.

In other exemplary embodiments, the antenna element may be shaped or configured differently. Rather than the entire antenna element being cone shaped, the antenna element may include only a portion or section that is substantially conical, substantially pyramidal, and/or that tapers in a longitudinal direction. For example, an antenna element may include a portion having a cone or pyramid shape and/or having sides that taper in the longitudinal direction to a point.

With continued reference to FIG. 18, the antenna element 202 includes a first portion 203 that is conical and a second portion 205 that is frustoconical. The antenna element 302 includes a first portion 303 that is conical and a second portion 305 that is cylindrical. The antenna element 402 has a first portion 403 that has a hexagonal pyramidal shape and a second portion 405 that has a hexagonal shape.

Some of the example embodiments disclosed herein may provide an indoor omnidirectional (vertically polarized) antenna, designed for covering 380 MHz to 6 GHz bands. A combination of the parasitic patch ring and the antenna element disclosed herein may help to enhance the bandwidth down to 380 MHz. The antenna 100 may be in a compact form, for example, having a ground plate diameter of 250 mm or less, a height of 135 mm or less, and an end cap diameter of 130 mm or less. By way of example only, the prototype antenna shown in FIG. 14 has a compact form with a ground plate diameter of 250 mm, a height of 134 mm, and an end cap diameter of 120 mm. A parasitic element (e.g., grounded patch ring parasitic element, etc.) may be used to help increase the bandwidth at lower frequencies, while allowing for a smaller, more compact antenna design. Some example embodiments have a more compact size than existing antenna structures, while keeping compatible radio frequency (RF) performance. These antennas may have high performance including high gain, low ripple, and low VSWR. The grounded patch ring parasitic element may generate the 400 MHz band with enhanced bandwidth.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail. In addition, advantages and improvements that may be achieved with one or more exemplary embodiments of the present disclosure are provided for purpose of illustration only and do not limit scope of the present disclosure, as exemplary embodiments disclosed herein may provide all or none of the above mentioned advantages and improvements and still fall within the scope of the present disclosure.

Specific dimensions, specific materials, and/or specific shapes disclosed herein are example in nature and do not limit the scope of the present disclosure. The disclosure herein of particular values and particular ranges of values for given parameters are not exclusive of other values and ranges of values that may be useful in one or more of the examples disclosed herein. Moreover, it is envisioned that any two particular values for a specific parameter stated herein may define the endpoints of a range of values that may be suitable for the given parameter (i.e., the disclosure of a first value and a second value for a given parameter can be interpreted as disclosing that any value between the first and second values could also be employed for the given parameter). For example, if Parameter X is exemplified herein to have value A and also exemplified to have value Z, it is envisioned that parameter X may have a range of values from about A to about Z. Similarly, it is envisioned that disclosure of two or more ranges of values for a parameter (whether such ranges are nested, overlapping or distinct) subsume all possible combination of ranges for the value that might be claimed using endpoints of the disclosed ranges. For example, if parameter X is exemplified herein to have values in the range of 1-10, or 2-9, or 3-8, it is also envisioned that Parameter X may have other ranges of values including 1-9, 1-8, 1-3, 1-2, 2-10, 2-8, 2-3, 3-10, and 3-9.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

The term "about" when applied to values indicates that the calculation or the measurement allows some slight imprecision in the value (with some approach to exactness in the value; approximately or reasonably close to the value; nearly). If, for some reason, the imprecision provided by "about" is not otherwise understood in the art with this ordinary meaning, then "about" as used herein indicates at least variations that may arise from ordinary methods of measuring or using such parameters. For example, the terms "generally," "about," and "substantially," may be used herein to mean within manufacturing tolerances.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper" and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

The foregoing description of the embodiments has been provided for purposes of illustration and description. It is not intended to be exhaustive or to limit the disclosure. Individual elements, intended or stated uses, or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. An omnidirectional broadband antenna comprising:

a ground element;

an antenna element electrically isolated from the ground element, the antenna element having at least one portion that is substantially conical, that has a substantially hexagonal pyramidal shape, or that tapers in a longitudinal direction; and an annular patch element electrically grounded to the ground element, the annular patch element surrounding at least a portion of the antenna element and parasitically coupled to the antenna element;

wherein the antenna is vertically polarized and operable at frequencies between about 380 MHz and about 6000 MHz with a voltage standing wave ratio (VSWR) less than or equal to about three to one (3:1), whereby the annular patch antenna element is configured to be operable as a $\lambda/4$ wave trap for an operating frequency band of 400 MHz to thereby broaden bandwidth.

2. The antenna of claim 1, wherein:

the annular patch element is configured to radiate a vertically polarized wave omnidirectionally in the azimuth plane in a first lower frequency band from 380 to 520 MHz, such that the directional gain of the antenna is substantial in the azimuth plane, and such that there is an omnidirectional radiation pattern emanating from the antenna element at a second higher frequency band from 700 to 6000 MHz; and the annular patch element comprises a symmetrical ring around the antenna element that makes the electrical fields be uniform and of about equal strength for all angles in the azimuth plane for an entire operating band of the antenna from 380 MHz to 6000 MHz.

3. The antenna of claim 1, wherein the annular patch element is an electrically-conductive ring having an opening in which is positioned the at least a portion of the antenna element.

4. The antenna of claim 1, wherein:

the antenna element has a conical, exponentially tapered form; and the antenna element has sides that are outwardly curved or convex sides such that a separation of the sides increases as an exponential function of length.

5. The antenna of claim 1, wherein the entire antenna element has a cone shape.

6. The antenna of claim 1, wherein the at least one portion of the antenna element conically widens in a longitudinal direction.

7. The antenna of claim 1, wherein the at least one portion of the antenna element has a cone shape.

8. The antenna of claim 1, wherein the at least one portion of the antenna element has a substantially hexagonal pyramidal shape.

9. The antenna of claim 1, wherein the at least one portion of the antenna element has sides that taper in the longitudinal direction to a point.

10. The antenna of claim 1, wherein the at least one portion of the antenna element is conical, and the antenna element includes another portion that is frustoconical.

11. The antenna of claim 1, wherein the at least one portion of the antenna element is conical, and the antenna element includes another portion that is cylindrical.

12. The antenna of claim 1, wherein the at least one portion of the antenna element has a hexagonal pyramidal shape, and the antenna element includes another portion that has a hexagonal shape.

13. The antenna of claim 1, wherein the entire antenna element has a cone shape that conically widens in a longitudinal direction, the antenna element having a circular base and sides that conically taper in an opposite longitudinal direction from the circular base to a point.

14. The antenna of claim 1, further comprising an antenna element holder connected to the ground element, the antenna element holder operable for holding the antenna element in place such that that antenna element is electrically isolated from the ground element.

15. The antenna of claim 1, wherein:

the antenna further comprises a coaxial plug element having an inner conductor and an outer conductor;

the ground element has an opening;

the outer conductor is electrically coupled to the ground element; and the inner conductor passes through the opening and is electrically coupled to the antenna element.

16. The antenna of claim 1, further comprising a radome coupled to the ground element, wherein the antenna element and annular patch element are within an internal space cooperatively defined between the radome and the ground element, and wherein the radome includes a closed, circular end cap portion and an open, circular base portion corresponding to a circular shape of the ground element.

17. The antenna of claim 1, further comprising one or more grounding pins mechanically fastened to the annular patch element and extending between the annular patch element and the ground element for electrically grounding the annular patch element to the ground element.

18. The antenna of claim 1, further comprising:

one or more electrically-conductive grounding pins extending between the annular patch element and the ground element for electrically grounding the annular patch element to the ground element; and one or more dielectric support pins extending between the annular patch element and the ground element for supporting the annular patch element such that the annular patch element is spaced apart from and generally parallel to the ground element.

19. A distributed antenna system including the antenna of claim 1, wherein the antenna is operable with:

a VSWR of less than or equal to about three to one (3:1) when operating in a frequency range between about 380 MHz and about 520 MHz;

a VSWR of less than or equal to about two to one (2:1) when operating in a frequency range between about 698 MHz and about 960 MHz; and a VSWR of less than or equal to about 1.8 to one (1.8:1) when operating in a frequency range between about 1710 MHz and about 6000 MHz.

20. An omnidirectional broadband antenna comprising:

a ground element;

an antenna element electrically isolated from the ground element, the antenna element having at least one portion that is substantially conical, that has a substantially hexagonal pyramidal shape, or that tapers in a longitudinal direction; and an annular patch element electrically grounded to the ground element, the annular patch element surrounding at least a portion of the antenna element and parasitically coupled to the antenna element, wherein:

the antenna is configured for mounting to a ceiling inside of a building; and the antenna is vertically polarized and operable at a range of operating frequencies between about 380 MHz and about 6000 MHz with a voltage standing wave ratio (VSWR) less than three to one (3:1), whereby the annular patch antenna element is configured to be operable as a $\lambda/4$ wave trap for an operating frequency band of 400 MHz to thereby broaden bandwidth.

* * * * *